US007451821B2

(12) United States Patent
Rashid et al.

(10) Patent No.: US 7,451,821 B2
(45) Date of Patent: Nov. 18, 2008

(54) BLOW OUT PREVENTER TRANSFER PLATFORM

(75) Inventors: Omar A. Rashid, Dhahran (SA); Robert J. Rawls, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 78 days.

(21) Appl. No.: 10/977,682

(22) Filed: Oct. 29, 2004

(65) Prior Publication Data

US 2005/0092497 A1 May 5, 2005

Related U.S. Application Data

(60) Provisional application No. 60/515,342, filed on Oct. 29, 2003.

(51) Int. Cl.
*E21B 29/12* (2006.01)
*E21B 7/12* (2006.01)

(52) U.S. Cl. ..... 166/358; 166/351; 405/201; 175/5

(58) Field of Classification Search ..... 166/358, 166/351; 405/195.1, 201
See application file for complete search history.

(56) References Cited

U.S. PATENT DOCUMENTS 3,031,167 A 4/1962 Roussel
3,043,255 A 7/1962 Bauer et al.
3,177,954 A 4/1965 Rand
3,189,093 A 6/1965 de Vries
3,333,562 A 8/1967 Deal, Jr. et al.
3,433,024 A * 3/1969 Diamond et al. ..... 405/196
3,662,822 A 5/1972 Wakefield, Jr.
3,699,988 A 10/1972 Weber
3,739,736 A 6/1973 Carreau et al.
3,740,957 A * 6/1973 McKenzie ..... 405/195.1
3,766,874 A 10/1973 Helm et al.
3,802,209 A 4/1974 Weaver
4,007,782 A * 2/1977 Nybo et al. ..... 166/79.1
4,081,163 A 3/1978 Guinn et al.
4,090,368 A * 5/1978 Bell et al. ..... 405/201
4,108,318 A * 8/1978 Rode et al. ..... 414/22.51
4,208,158 A * 6/1980 Davies et al. ..... 414/22.68
4,230,190 A 10/1980 Guinn et al.
4,367,796 A * 1/1983 Bolding ..... 166/341
4,401,398 A * 8/1983 Remson ..... 405/201
4,658,903 A 4/1987 Tateishi
4,716,972 A * 1/1988 Makinen et al. ..... 175/8
5,139,367 A * 8/1992 Ingle ..... 405/201
5,407,302 A 4/1995 Springett et al.
5,490,364 A * 2/1996 Desai et al. ..... 52/637

(Continued)

*Primary Examiner*—Thomas A Beach
(74) *Attorney, Agent, or Firm*—Bracewell & Giuliani LLP

(57) ABSTRACT

An offshore well drilling assembly includes a drilling facility or support platform for location at sea. A drilling platform connects to the support platform so the drilling platform is cantilevered from the support platform. The drilling platform extends from the support platform, for positioning over a subsea well. The well drilling assembly includes a staging platform for use in loading and unloading of wellhead equipment. The staging platform is mounted to the drilling platform. The staging platform moves along a side of the drilling platform in directions toward and away from the support platform to a distance over the sea. A method of conveying wellhead equipment uses the staging platform for conveying wellhead equipment between the support platform and a distance over the sea by moving the staging platform along the drilling platform.

16 Claims, 4 Drawing Sheets

U.S. PATENT DOCUMENTS 5,647,443 A * 7/1997 Broeder ..... 175/5
5,697,446 A * 12/1997 Giannesini ..... 166/354
6,481,931 B1 11/2002 Welsh
6,705,414 B2 * 3/2004 Simpson et al. ..... 175/52
6,729,804 B1 * 5/2004 Roodenburg et al. ..... 405/201
6,766,860 B2 * 7/2004 Archibald et al. ..... 166/341
7,083,004 B2 * 8/2006 Roodenburg et al. ..... 175/5

* cited by examiner

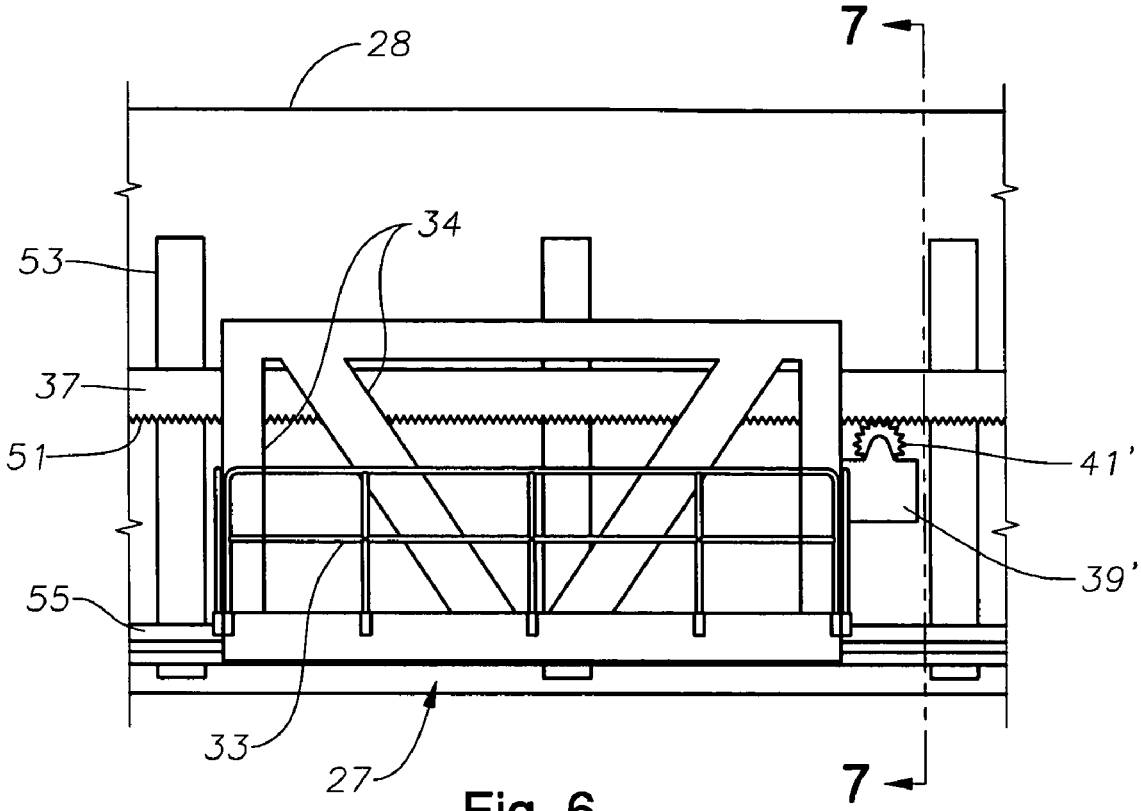
Fig. 6
Fig. 7
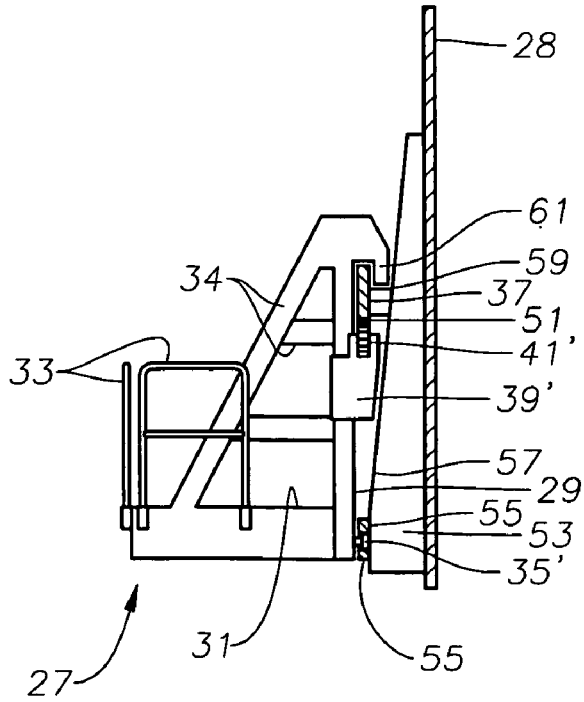

BLOW OUT PREVENTER TRANSFER PLATFORM

RELATED APPLICATIONS

This nonprovisional patent application claims the benefit of co-pending, provisional patent application U.S. Ser. No. 60/515,342, filed on Oct. 29, 2003, which is hereby incorporated by reference in its entirety.

BACKGROUND OF THE INVENTION

1. Field of the Invention

The present invention relates generally to offshore drilling operations, and more specifically to an apparatus for removing and installing drilling equipment.

2. Background of the Invention

An offshore drilling facility includes a drilling rig for various operations performed while drilling a subsea well. A conductor casing extends from the subsea well to an elevation above the surface of the water, where a working platform is connected to an upper portion of the conductor casing for drilling operators to work. On many facilities, the drilling rig is often supported by a drilling platform or cantilever that extends from a side of the drilling facility, over the water, to a location above the drilling platform and conductor casing.

A string of drill pipe is lowered from the drilling rig, through an opening in the cantilever, into the conductor casing for conducting drilling operations. A blow out preventer (BOP), typically located within the cantilever, engages the upper end of the conductor casing. The BOP regulates fluid flow out of the conductor casing from the subsea well. There are numerous types of BOPs. For example, some have rams that clamp down on the conductor casing. Others are annular which contract to enclose around a drill sting. The term "BOP" as used in this application is not meant to designate either device, but rather to encompass each type known or foreseeable in the art. BOPs can weigh up to 40,000 lbs., and have large pieces that are cumbersome while being moved between various positions.

During some operations, the BOP must be removed. During these operations, the BOP is typically hoisted and slid along rails to another location within the cantilever. Should a BOP need replacing or to be removed from the drilling facility, the upper surface of the cantilever prevents a crane from lifting the BOP from the storage or stowed position. Rather, the BOP must be moved to a location below the opening the drill pipe typically extends through for engaging the conductor casing.

The drilling rig cannot lift the BOP and continue drilling operations through the same opening in the upper surface of the cantilever. Therefore, the drilling rig discontinues drilling operations and disconnects from the conductor casing to lift the BOP out of the cantilever. Accordingly, the cantilever and drilling rig must be lifted, or "jacked up", relative to the conductor casing in order to disconnect from the conductor casing and allow room for the BOP over the conductor casing. In order to lower the BOP onto a vessel, the drilling rig is then slid on the cantilever so that the BOP is at a position that is not directly above the conductor casing. Because the BOP is being lowered from the drilling rig, the vessel is in close proximity to the conductor casing and the supports of the facility. This creates a dangerous environment for the workers and the facilities. During normal weather conditions, this removal process can take two to three days. Under rough weather conditions, the process can take four to six days.

SUMMARY OF THE INVENTION

An offshore well drilling assembly includes a drilling facility or support platform for location at sea. A drilling platform is connected to the support platform such that the drilling platform is cantilevered from the support platform. The drilling platform extends from the support platform, and is positioned over the sea, for positioning over a subsea well. The well drilling assembly includes a staging platform for use in loading and unloading of wellhead equipment. The staging platform is mounted to the drilling platform. The staging platform moves along a side of the drilling platform in directions toward and away from the support platform to a distance over the sea.

The drilling assembly can also include a rail for the staging platform to move along. The platform can be driven by a motor located on the support platform or on the staging platform. The staging platform can be move along the outside of the drilling platform or along an inside of the drilling platform and extend onto the support platform. The drilling platform can include an opening for the drilling rig to conduct operations on the subsea well. The platform moves along between the support platform and a distance at least as far away from the support platform as the opening.

The drilling facility can also include a lower rail to help guide the staging platform along the side of the drilling platform. A plurality of columns, extending from a wall located along the drilling platform, can support the rails such that the lower rail is farther away from the drilling platform. The lower rail can guide a roller located on the staging platform.

BRIEF DESCRIPTION OF THE DRAWINGS

FIG. 6 is an enlarged perspective view of the platform in the alternative embodiment of FIG. 5.

FIG. 7 is an enlarged side view of the platform in the alternative embodiment of FIG. 5.

DETAILED DESCRIPTION OF THE PREFERRED EMBODIMENT

Figure 1:
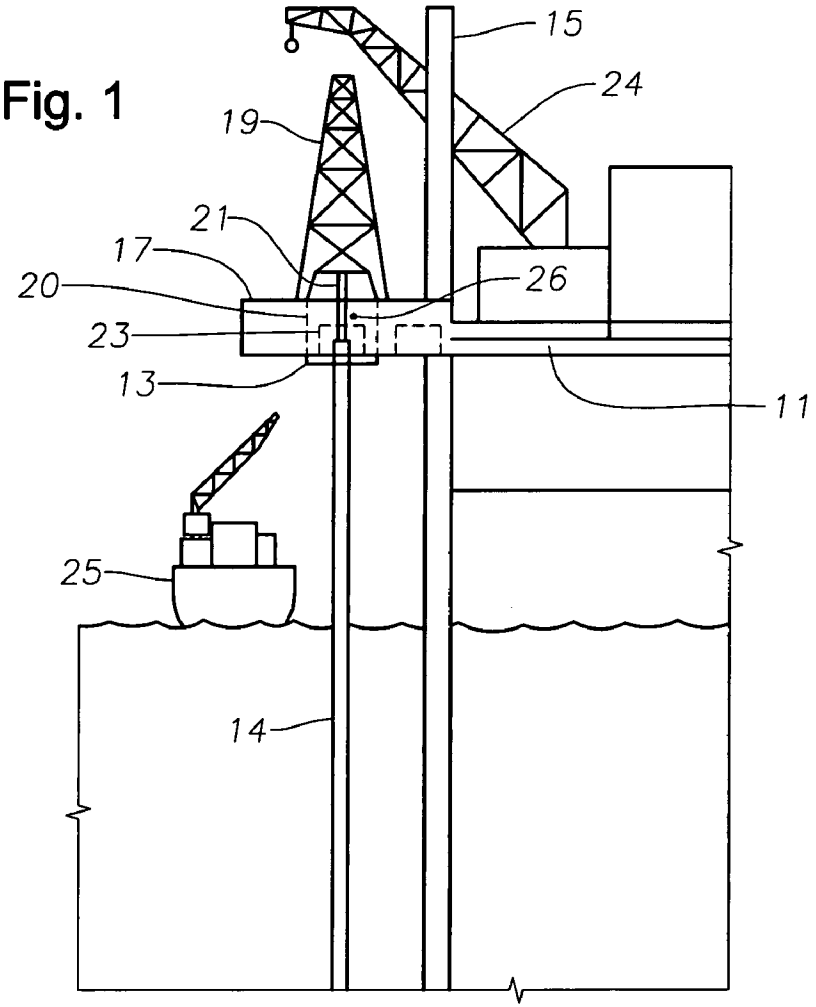
FIG. 1 is a perspective view of an offshore drilling facility constructed in accordance with this invention, with a vessel located adjacent the drilling facility.

Referring to FIG. 1, a support platform or offshore drilling facility 11 is located adjacent a working platform 13 formed toward an upper portion of a conductor casing 14 extending from a subsea well. A plurality of legs 15 support facility 11 above the surface of the water. A drilling platform or cantilever 17 extends from a side of facility 11 over the water and working platform 13. A drilling rig 19 is located on cantilever 17, above working platform 13, for conducting drilling operations. Cantilever 17 includes a vertical opening 20 for drilling rig 19 to engage conductor casing 14. A string of drill pipe 21 extends from drilling rig 19, through cantilever 17, and enters conductor casing 14 above working platform 13. A motor or drive unit (not shown), typically located in drilling rig 19, rotates drill pipe 21 during drilling operations. A crane 24 is preferably located on facility 11 for moving equipment and the loading and unloading equipment and supplies. A vessel 25 is located adjacent conductor casing 14 opposite from facility 11 for loading and unloading drilling equipment.

Figure 2:
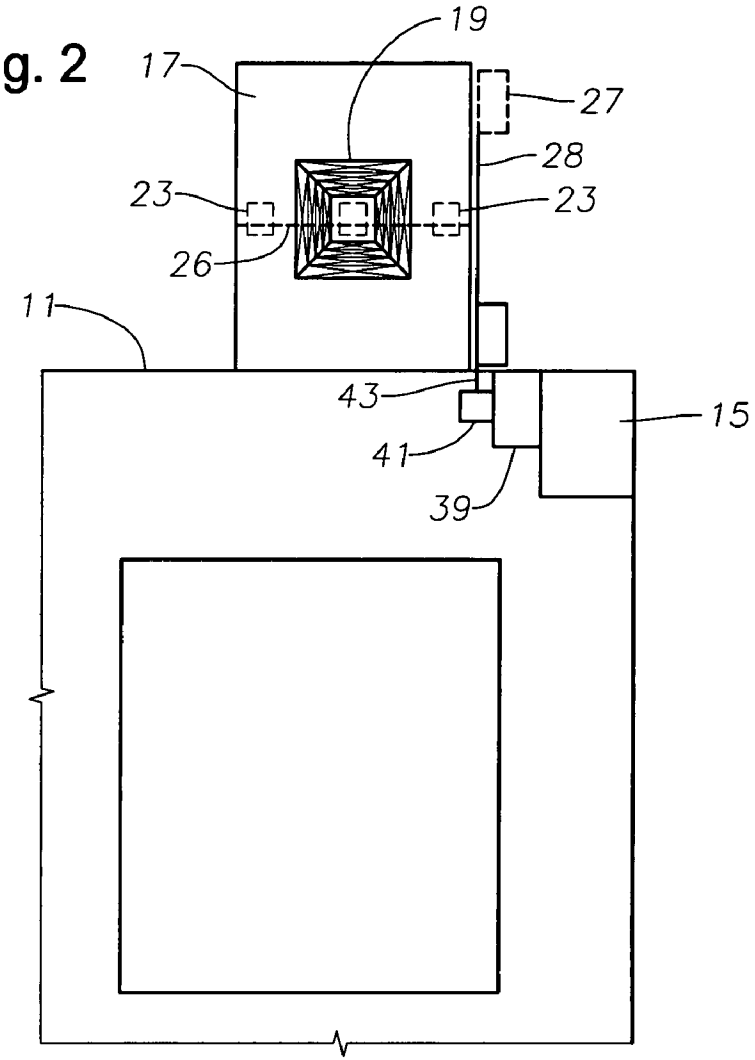
FIG. 2 is a top plan schematic view of the drilling facility shown in FIG. 1.

During typical drilling operations, a blow out preventer (BOP) 23 is located within cantilever 17, below drilling rig 19. BOP 23 engages an upper end of conductor casing 14 to regulate or prevent fluid flow through the upper end of conductor casing 14 during specific operations, or during emergencies. In some operations, BOP 23 is removed from conductor casing 14. For example, this may be while a tree is being installed. BOP 23 is moved within cantilever 17 to a stowed or storage position away from conductor casing 14, as shown in FIG. 1. Typically, with the assistance of pulleys (not shown), movement of BOP 23 is along an overhead rail 26 because of the weight and size of BOP 23 and its associated parts. When BOP 23 is not located within opening 20, BOP 23 is in a storage or stowed position within cantilever 17. As shown in FIG. 2, the stowed position can be to a side of opening 20 and conductor casing 14, or aft—closer to the main portion of facility 11 (not shown). With either stowed position, BOP 23 is within cantilever 17.

Previously, when installing or removing BOP 23 within cantilever 17, BOP 23 was lifted through opening 20 because crane 24 cannot reach BOP 23 below the deck of cantilever 17. Therefore, during replacement and removal operations, BOP 23 was positioned within opening 20, and drilling rig 19 disengaged from drilling operations for lifting and lowering BOP 23 to vessel 25. This is a time consuming, dangerous, and expensive operation.

Figure 4:
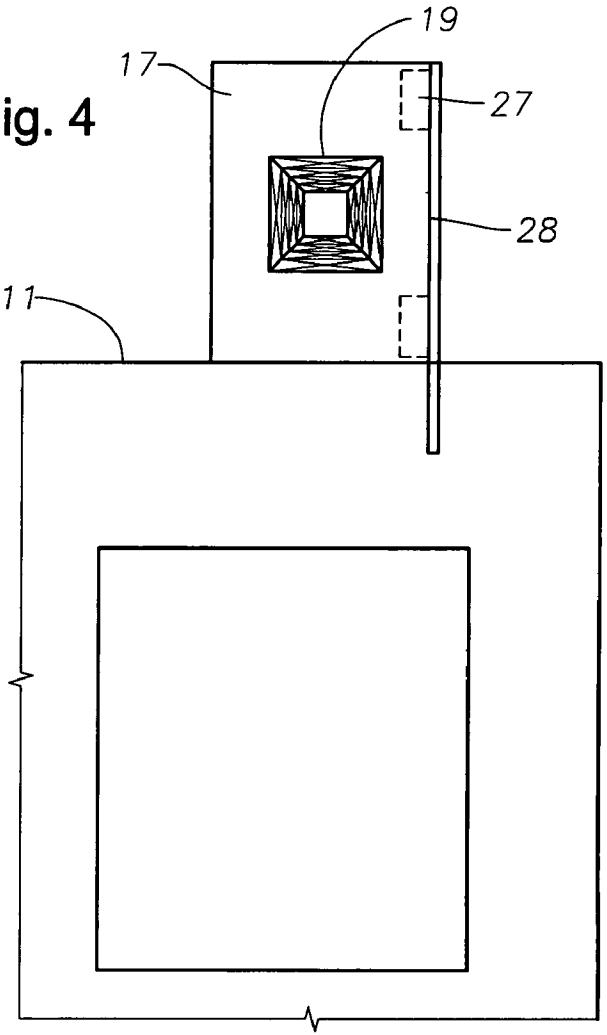
FIG. 4 is a top plan schematic view of an alternative embodiment of the drilling facility shown in FIG. 2.
Figure 3:
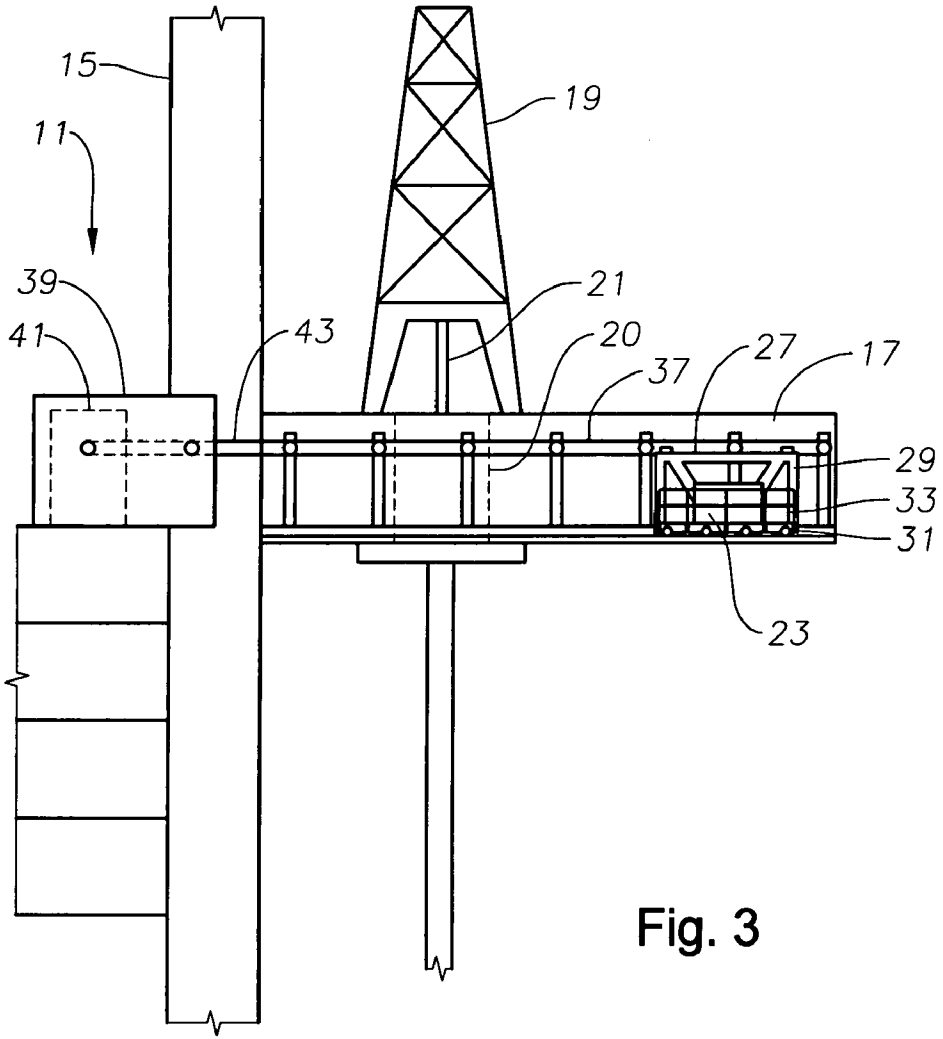
FIG. 3 is an enlarged perspective view of a portion of the drilling facility shown in FIG. 1, and showing a loading and unloading assembly constructed in accordance with this invention.

Referring to FIGS. 2 and 3, a staging platform 27, connected to an side of cantilever 17, is moveable between aft (adjacent to facility 11) and bow (away from facility 11) positions. Staging platform 27 is preferably mounted to a wall 28 positioned along a side of cantilever 17. As desired, staging platform 27 move along an outside portion of cantilever 17 (FIG. 2) or move along an inside portion of cantilever 17 (FIG. 4). Staging platform 27 comprises a side 29 adjacent cantilever 17, a base 31 defining a floor of staging platform 27, and preferably a guardrail 33 extending from the base. Staging platform 27 has been made in a manner known in the art for supporting large masses, for example, at least 40,000 lb. weight of BOP 23. For example, in the preferred embodiment, staging platform 27 includes a plurality of trusses 34 designed to support the loads described above. Preferably, a plurality of rollers 35 are located along side 29 of staging platform 27, adjacent the side of cantilever 17 that staging platform 27 slides. At least one rail 37 engages rollers 35 for supporting staging platform 27 from the side of cantilever 17. Rollers 35 engage rails 37 for staging platform 27 to more easily slide along the side of cantilever 17. Preferably, cantilever 17 is equipped with rails 26 leading to an opening for loading BOP 23 or other equipment onto staging platform 27.

A drive assembly, comprising a motor 39 and gear assembly 41, engage a tensionable draw line 43 for moving staging platform 27 between aft and bow positions. Gear assembly 41 can comprise a toothed end of a shaft extending from motor 39 that directly engages draw line 43, or a plurality of toothed gears that are rotated by a shaft from motor 39 and engage draw line 43. In the preferred embodiment, motor 39 is a bi-directional motor in order to engage draw line 43 to move staging platform both toward and away from facility 11. In either embodiment, the toothed surface is rotated by motor 39, and acts as a pinion for engaging draw line 43.

Draw line 43 can be any known apparatus for engaging a toothed gear or pinion. For example, draw line 43 can be a loop of chain links that loop around gear assembly 41 to pull either the upper or lower portions of the chain loop, depending on the direction of rotation of the pinion, to slide platform between aft and bow positions. Alternatively, draw line 43 could also be a metal rod with a toothed profile for tangentially engaging the pinion, so that the rod and staging platform 27 slide between aft and bow positions depending upon the direction of rotation of the pinion. As is readily apparent by those skilled in the art, there are numerous alternatives for moving an object closer or farther away from motor 39 located on facility 11.

Figure 5:
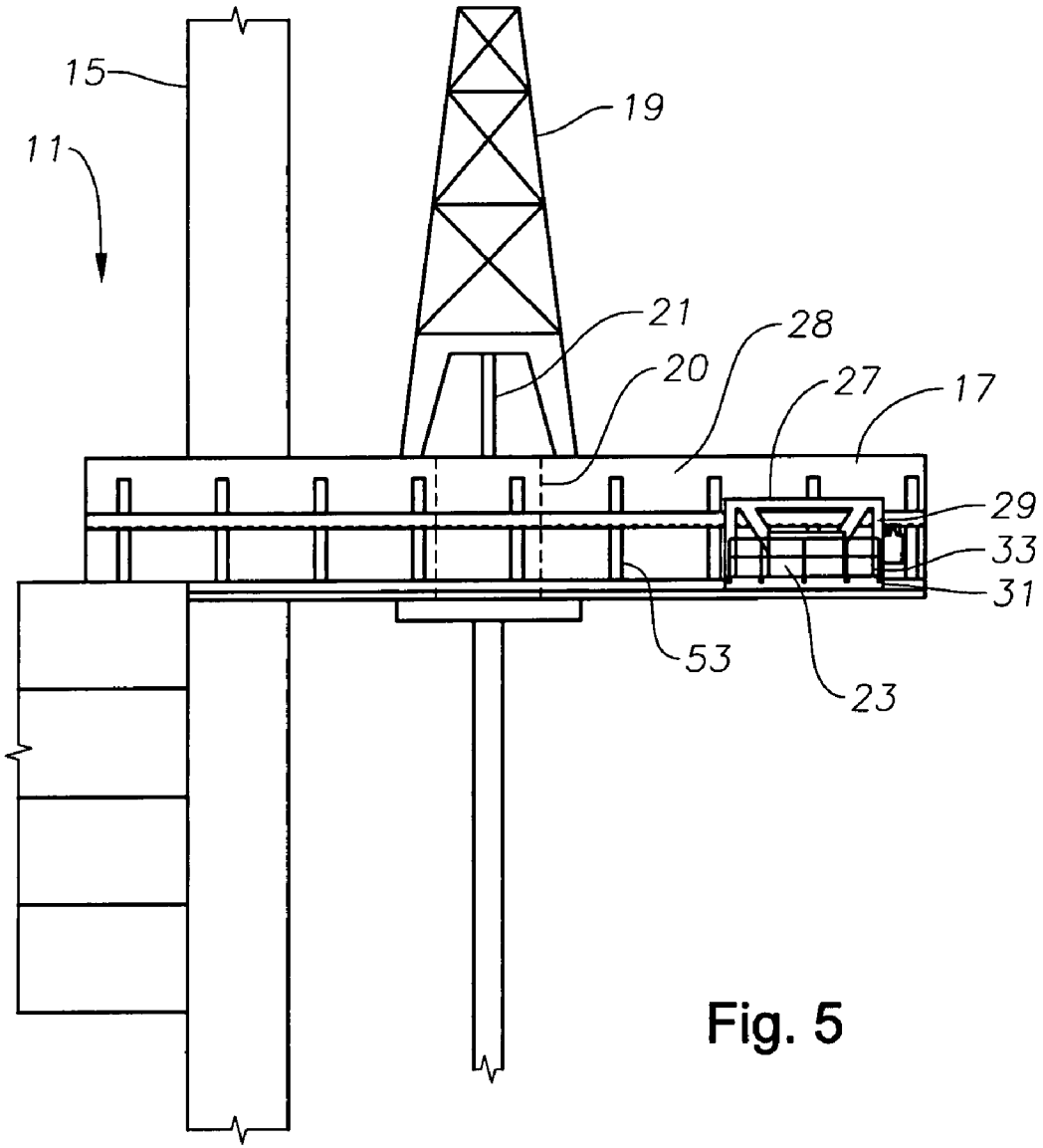
FIG. 5 is perspective view of an alternative embodiment of the drilling facility shown in FIG. 3.

In the embodiment shown in FIGS. 5-7, staging platform 27 slides along rail 37, with motor 39' and gear 41' being located on staging platform 27. A plurality of teeth 51 are formed on rail 37 for gear 41' to engage in order to move staging platform 27 along rail 37. As best shown in FIG. 6, a plurality of support columns 53 are connected to the wall 28. In the preferred embodiment, support columns 53 connect rail 37 to wall 28 via a support member 59 (FIG. 7). A base rail 55 is preferably positioned below rail 37 for guiding rollers 35' extending from base 31 of staging platform 27. Columns 53 also support base rail 55. Preferably, columns 53 have inclined faces 57 so that base rail 55 extends farther away from wall 28 than rail 37. In the preferred embodiment, a rear support 61 extends from staging platform 27 over rail 37 to the side of rail 37 closest to wall 28.

In operation, BOP 23 is removed from conductor casing 14 in a manner readily known in the art, and drilling rig 19 can continue with operations. BOP 23 is loaded onto staging platform 27 from within cantilever 17. Preferably this is performed with the assistance of rails 26 and a side opening in cantilever 17 near a stowed position for BOP 23. After securing BOP 23 to staging platform 27, motor 39 engages draw line 43 through gear assembly 41, to move staging platform 27 away from facility 11 to the bow of cantilever 17. Rollers 35 turn along rails 37 to allow for easier movement of staging platform 27 relative to the side of cantilever 17. Staging platform 27 slides along rails 37 and wall 28 to a position farther away from facility 11 than opening 20, rig 19, and conductor casing 14.

Crane 24 offloads BOP 23 from staging platform 27 to vessel 25. Vessel 25 remains a greater distance away from facility 11 than conductor casing 14, which reduces collision dangers previously associated with loading an unloading a BOP from an offshore facility. Using crane 24 from vessel 25 allows the operator to continue using rig 19 for drilling operations rather than lifting and lowering BOP 23. Using crane 24 also allows vessel 25 to load and unload BOP 23 from a position that is not as close to conductor casing 14 as leg 15 was previously required when using rig 19 to load and unload BOP 23.

The description and figures are merely illustrative of various embodiments. While the invention has been shown in only some of its forms, it should be apparent to those skilled in the art that it is not so limited, but is susceptible to various changes without departing from the scope of the invention. For example, while the equipment being transferred by platform has been described as BOP 23, it will be readily apparent to those skilled in the art that staging platform 27 can be used for transferring a variety of wellhead equipment, like rams and swivels.

That claimed is:

1. An offshore well drilling assembly, comprising:

a support platform for location at sea;

a drilling platform cantilevered to the support platform, the drilling platform having a bow end spaced from the drilling platform and two lateral sides extending from the bow end to the support platform, the drilling platform extending from the support platform for positioning over a subsea well;

a derrick mounted on the drilling platform;

a staging platform for use in loading and unloading of wellhead equipment, the staging platform being mounted to and along only one of the lateral sides of the drilling platform, the staging platform being moveable along said only one of the lateral sides of the drilling platform in directions toward and away from the support platform, the staging platform having a horizontal support assembly for supporting the wellhead equipment, the horizontal support assembly not being located beneath the drilling platform while the drilling platform is in an operational position; and a transverse conveyor under the drilling platform for transporting wellhead equipment from a position under the drilling platform to the staging platform.

2. The offshore well drilling assembly of claim 1, wherein the wellhead equipment includes a blow out preventer for location on an upper end of a drilling riser.

3. The offshore well drilling assembly of claim 1, further comprising a rail connected to the drilling platform and the staging platform being suspended from the rail.

4. The offshore well drilling assembly of claim 1 further comprising a rack and pinion assembly that supports and moves the staging platform.

5. The offshore well drilling assembly of claim 1 wherein the staging platform is cantilevered to said only one of the lateral sides of the drilling platform.

6. The offshore well drilling assembly of claim 1, wherein the drilling platform further comprises an opening for communication with the subsea well, the staging platform being movable away from the support platform to a distance at least equal to the distance between the support platform and the opening.

7. The offshore well drilling assembly of claim 6, wherein the staging platform moves along a line that does not intersect with the opening.

8. The offshore well drilling assembly of claim 1, wherein the staging platform comprises a vertical support assembly that is cantilevered relative to said only one lateral side of the drilling platform, the horizontal support assembly extends away from vertical support assembly, and the wellhead equipment being loaded and unloaded onto the horizontal support assembly.

9. In an offshore facility at sea having a support platform, a drilling platform cantilevered to the support platform and extending over the sea, a derrick mounted to the drilling platform, and an opening formed in the drilling platform for the derrick to register with a subsea well, the offshore facility comprising:

a staging platform for use in loading and unloading of wellhead equipment, the staging platform being mounted to and cantilevered along only one side of the drilling platform, the staging platform being moveable along said side of the drilling platform in directions toward and away from the support platform, the staging platform having a horizontal support assembly for supporting the wellhead equipment, such horizontal support assembly not being located beneath the drilling platform while the drilling platform is in an operational position;

a first rail connected to said side of the drilling platform, the staging platform being mounted to the first rail; and a second rail connected to and under the drilling platform and extending along a path that extends from the opening towards and transverse to the first rail for transferring the equipment from the second rail to the staging platform.

10. The offshore facility of claim 9, wherein the wellhead equipment includes a blow out preventer for location on an upper end of a drilling riser.

11. The offshore facility of claim 9, wherein the staging platform is moveable away from the support platform to a distance at least equal to the distance between the support platform and the opening.

12. The offshore facility of claim 9, wherein the first rail includes a rack and pinion assembly that supports and moves the staging platform.

13. The offshore facility of claim 9, wherein the staging platform comprises a vertical support assembly that is cantilevered relative to the first rail, the horizontal support assembly extending away from vertical support assembly, the wellhead equipment being loaded and unloaded onto the horizontal support assembly.

14. A method of conveying wellhead equipment for an offshore well drilling assembly having a support platform, a drilling platform cantilevered from the support platform, and a derrick mounted to the drilling platform, the method comprising:

(a) mounting a staging platform only to a first rail, the first rail being mounted to and along only one side of the drilling platform, the staging platform not being under the drilling platform while the drilling platform is in an operational position;

(b) conveying wellhead equipment along a second rail from beneath the drilling platform to the staging platform; and (c) moving the staging platform with the wellhead equipment thereon along the first rail relative to the drilling platform.

15. The method of claim 14, wherein step (a) further comprises mounting the staging platform on the first rail cantilevered to the drilling platform.

16. The method of claim 14, wherein the wellhead equipment is conveyed with the staging platform a distance farther away from the support platform than the opening.

* * * * *